US011007404B2

(12) United States Patent
Yoo

(10) Patent No.: US 11,007,404 B2
(45) Date of Patent: May 18, 2021

(54) TREADMILL

(71) Applicant: DRAX INC., Anyang-si (KR)

(72) Inventor: Seon Kyung Yoo, Seoul (KR)

(73) Assignee: Drax Inc., Anyang-si (KR)

( * ) Notice: Subject to any disclaimer, the term of this patent is extended or adjusted under 35 U.S.C. 154(b) by 27 days.

(21) Appl. No.: 16/170,903

(22) Filed: Oct. 25, 2018

(65) Prior Publication Data

US 2019/0060705 A1 Feb. 28, 2019

Related U.S. Application Data

(63) Continuation of application No. PCT/KR2017/004345, filed on Apr. 25, 2017.

(30) Foreign Application Priority Data

Apr. 25, 2016 (KR) ..... 10-2016-0050124
Mar. 6, 2017 (KR) ..... 10-2017-0028546

(51) Int. Cl.
*A63B 22/02* (2006.01)

(52) U.S. Cl.
CPC ..... *A63B 22/0285* (2013.01); *A63B 22/02* (2013.01); *A63B 2022/0278* (2013.01); *A63B 2209/00* (2013.01)

(58) Field of Classification Search
CPC .... B65G 17/06; B65G 17/061; B65G 17/063; B65G 17/065; B65G 17/067; B65G 17/08;

(Continued)

(56) References Cited

U.S. PATENT DOCUMENTS 6,042,514 A 3/2000 Abelbeck
8,790,222 B2 7/2014 Burger
(Continued)

FOREIGN PATENT DOCUMENTS

JP 2926381 B2 * 7/1999
JP 2007009501 A * 1/2007
(Continued)

OTHER PUBLICATIONS

Modern Steel Construction Corrugated Web I-Beams [online], Published Jul. 1999, [retrieved on Feb. 4, 2020], Retrieved from the Internet <URL: https://www.aisc.org/globalassets/modern-steel/archives/1999/07/1999v07_fabrication_tools.pdf> (Year: 1999).*
(Continued)

*Primary Examiner* — Garrett K Atkinson
*Assistant Examiner* — Zachary T Moore
(74) *Attorney, Agent, or Firm* — Knobbe Martens Olson & Bear LLP

(57) ABSTRACT

Provided is a treadmill. The treadmill includes a first frame and a second frame, a front roller and a rear roller respectively provided in the first frame and the second frame and a plurality of slats extending perpendicularly to a direction in which the first frame and the second frame are located. The slats are located between the first frame and the second frame and installed movably with respect to the first frame and the second frame. Some of the plurality of slats include a base portion providing a first surface and a strength reinforcing portion protruding from the base portion. The strength reinforcing portion includes a first reinforcing portion protruding from the base portion and a second reinforcing portion extending in a direction intersecting a protrusion direction of the first reinforcing portion, the second reinforcing portion provides a second surface.

9 Claims, 16 Drawing Sheets

(58) Field of Classification Search
CPC .... B65G 17/083; B65G 17/086; B65G 25/02; B65G 25/06; B65G 25/065; A63B 22/02; A63B 22/0285; A63B 22/0207; A63B 22/0235
See application file for complete search history.

(56) References Cited

U.S. PATENT DOCUMENTS

| | | | | |
|---|---|---|---|---|
| 2014/0213419 | A1 | 7/2014 | Bayerlein et al. | |
| 2015/0210348 | A1* | 7/2015 | Astilean ..... | A63B 22/0285 280/228 |

FOREIGN PATENT DOCUMENTS

| | | | |
|---|---|---|---|
| KR | 10-2009-0075896 | A | 7/2009 |
| KR | 20-0487810 | Y1 | 11/2018 |

OTHER PUBLICATIONS

Engineering Toolbox, American Wide Flange Beams, [online], Published Aug. 3, 2015, [retrieved on Feb. 4, 2020], Retrieved from <URL: https://web.archive.org/web/20150803104952/https://www.engineeringtoolbox.com/american-wide-flange-steel-beams-d_1318.htmlf> (Year: 2015).*

Design Construction, The Tricky Ribs [online], Publish Date: Nov. 24, 2007, Retrieved from the Internet <URL: https://isadikin.wordpress.com/2007/11/24/designers-pitfall-1-the-tricky-ribs/>(Design). (Year: 2007).*

International Search Report of corresponding Patent Application No. PCT/KR2017/004345—5 pages (dated Jul. 11, 2017).

Office Action of corresponding Korean Patent Application No. 10-2016-0050124—7 pages (dated Jan. 23, 2017).

Office Action of corresponding Korean Patent Application No. 10-2017-0028546—9 pages (dated Oct. 27, 2017).

Supplementary European Search Report in European Patent Application No. 17 78 9871 dated Dec. 11, 2019.

* cited by examiner

TREADMILL

CROSS-REFERENCE TO RELATED APPLICATIONS

This application is a continuation application, and claims the benefit under 35 U.S.C. §§ 120 and 365 of PCT Application No. PCT/KR2017/004345, filed on Apr. 25, 2017, which is hereby incorporated by reference. PCT/KR2017/004345 also claimed priority from Korean Patent Application No. 10-2016-0050124 filed on Apr. 25, 2016 and Korean Patent Application No. 10-2017-0028546 filed on Mar. 6, 2017, both of which are hereby incorporated by reference.

BACKGROUND

The present disclosure relates to a treadmill.

A treadmill is an exercise machine that gives the effect of a walking or running exercise in a small space using a belt rotating along an infinite orbit, and is also called a running machine. Demands for treadmills are ever increasing because treadmills allow users to walk or run indoors at proper temperatures, regardless of the weather.

Recently, to meet various needs of consumers about treadmills, new types of treadmills have been developed.

For example, to reproduce the effect of landing on the ground in a track, a treadmill having a slat belt structure is under development. The slat belt structure includes two belts arranged in parallel with each other and a plurality of slats that extend perpendicularly to a rotating direction of the belts and are connected between the two belts. Users exercise contacting the slats instead of the belts, so that the users may feel like exercising in a real track as compared to exercising on a treadmill having an existing simple belt structure.

However, since the slat belt structure needs to bear a load of a user and absorb a shock during a user's exercise, a slat may be excessively bent or damaged when the slat has a strength lower than a certain level.

SUMMARY

Provided is a treadmill capable of optimizing a manufacturing cost while securing a strength of a slat.

According to an aspect of the present disclosure, a treadmill includes: a first frame and a second frame arranged in parallel with each other; a front roller and a rear roller respectively provided in the first frame and the second frame; and a plurality of slats extending perpendicularly to a direction in which the first frame and the second frame are located, the slats being located between the first frame and the second frame and installed movably with respect to the first frame and the second frame, wherein at least some of the plurality of slats may include a base portion providing a first surface and a strength reinforcing portion protruding from the base portion, and the strength reinforcing portion may include a first reinforcing portion protruding from the base portion; and at least one second reinforcing portion extending in a direction intersecting a protrusion direction of the first reinforcing portion, the at least one second reinforcing portion providing a second surface.

A width of the second reinforcing portion may be less than a width of the base portion.

The width W2 of the second reinforcing portion may satisfy a relational expression below with respect to the width W1 of the base portion, a protrusion height h1 of the first reinforcing portion, and a radius R of the rear roller: $W2 \leq (R-h1)/R \cdot W1$.

The width of the second reinforcing portion may be 0.2 times to 0.8 times the width of the base portion.

The width of the second reinforcing portion may be two times to five times a thickness of the second reinforcing portion.

The width of the base portion may be 3 mm to 150 mm.

The width of the second reinforcing portion may be greater than a width of the first reinforcing portion.

The width of the second reinforcing portion may be at least twice the width of the first reinforcing portion.

The width of the second reinforcing portion may be at least five times the width of the first reinforcing portion.

A cross-section of the strength reinforcing portion may have a T-shape.

A protrusion height of the first reinforcing portion may be less than a radius of the rear roller.

A width of the first reinforcing portion may be at most half of a width of the base portion.

A length of the strength reinforcing portion may be less than a length of the base portion.

The first surface and the second surface may be plane and parallel with each other.

The second reinforcing portion may include a separation region separated from the base portion and a contact region located at each of opposite ends of the separation region, the contact region being in contact with the base portion.

The first surface may be plane and the second surface may be curved.

The strength reinforcing portion may include at least one rib protruding from the base portion, the at least one rib being located between the second reinforcing portion and the base portion and supporting the first reinforcing portion.

The at least one rib may protrude from the base portion perpendicularly to the first surface.

The at least one rib may protrude from the base portion to be at an acute or obtuse angle to the first surface.

A cross-section of the first reinforcing portion, taken parallel to the first surface, may have a zigzag shape or a shape of waves.

The plurality of slats may include plastic or aluminum.

The plurality of slats may be connected with each other by a first belt and a second belt, the first belt and the second belt having an endless form.

Adjacent slats among the plurality of slats may be connected with each other by a link.

A plurality of insertion portions may be formed in the first reinforcing portion.

The insertion portions may have a hole shape.

Other aspects, features, and advantages than those described above will be clear from the accompanying drawings, the claims, and the description of embodiments below.

These general and specific aspects may be embodied using a system, a method, a computer program, or a combination thereof.

According to embodiments of the present disclosure, by changing the design of the structure of a slat, noise may be prevented while securing the strength of the slat and optimizing a manufacturing cost.

DETAILED DESCRIPTION

Figure 1:
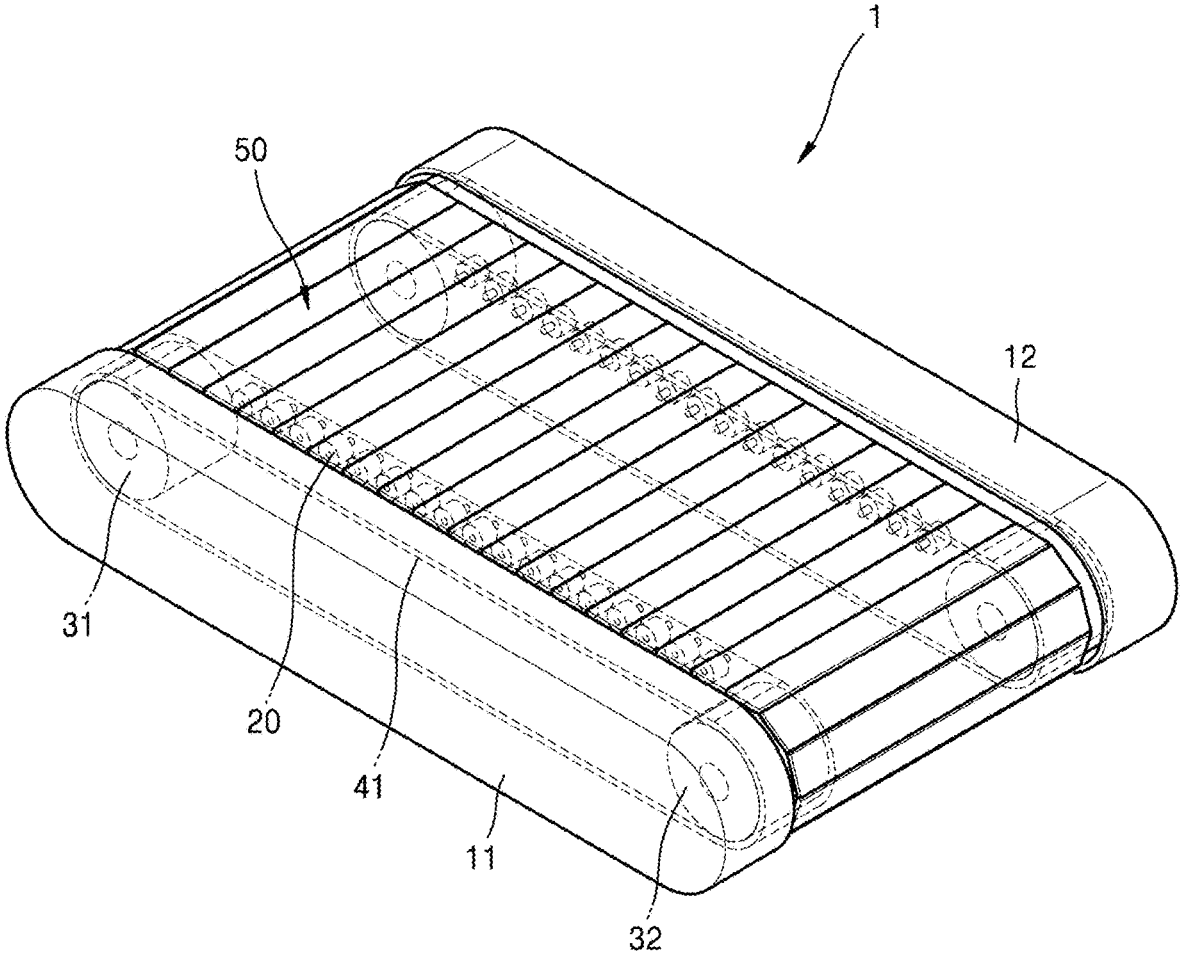
FIG. 1 is a perspective view schematically illustrating a treadmill according to an embodiment of the present disclosure.

Embodiments of the present disclosure will be described in detail with reference to the accompanying drawings. In the drawings, like reference numerals denote like elements and the size or thickness of elements may be exaggerated for clarity of the description.

Figure 2:
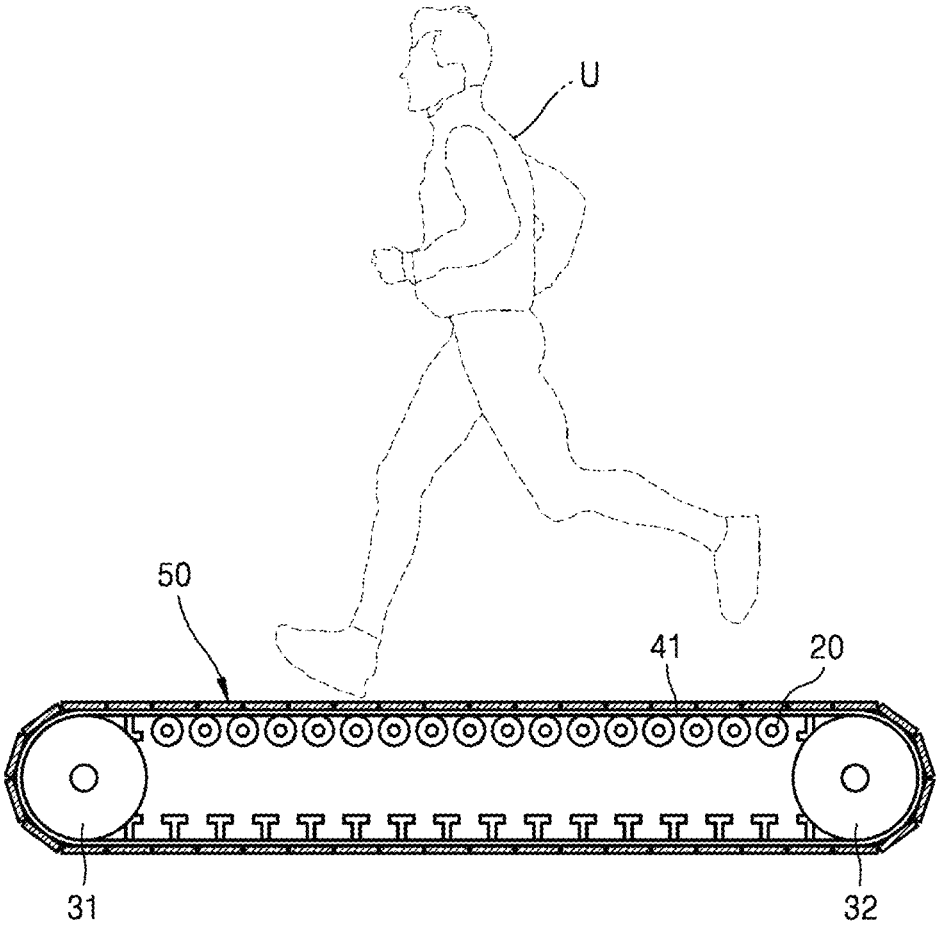
FIG. 2 is a side view of the treadmill of FIG. 1.
Figure 3:
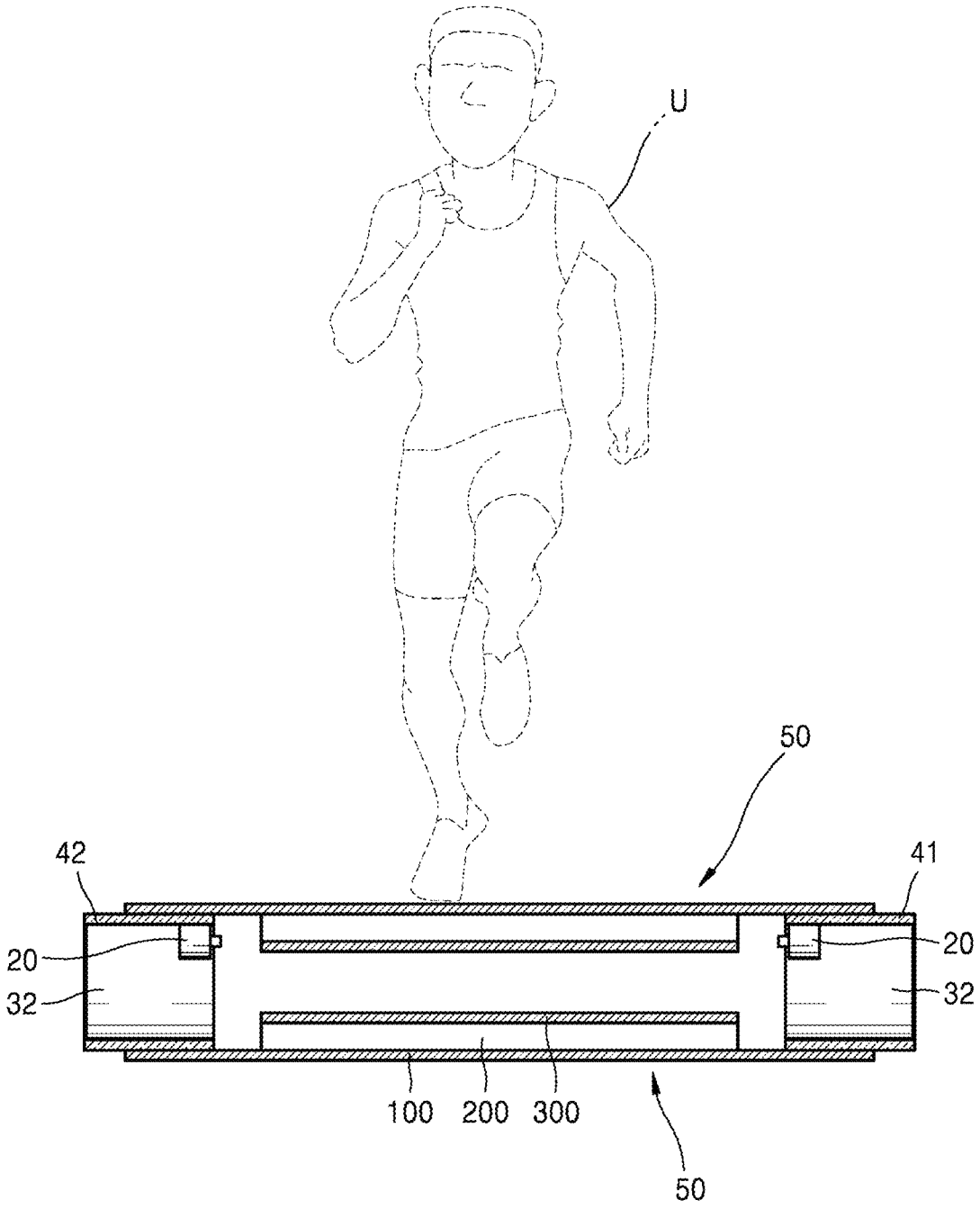
FIG. 3 is a cross-sectional view of the treadmill of FIG. 1.

FIG. 1 is a perspective view schematically illustrating a treadmill 1 according to an embodiment of the present disclosure. FIG. 2 is a side view of the treadmill 1 of FIG. 1, and FIG. 3 is a cross-sectional view of the treadmill 1 of FIG. 1. For convenience's sake in the description, first and second frames 11 and 12 in FIG. 1 are omitted in FIGS. 2 and 3.

Referring to FIGS. 1 through 3, the treadmill 1 includes the first frame 11, the second frame 12, a plurality of bearings 20, a front roller 31, a rear roller 32, a first belt 41, a second belt 42, and a plurality of slats 50. Here, the front and the rear will be defined as a front direction and a rear direction of a user U when the user U performs a normal exercise.

The first frame 11 and the second frame 12 are spaced apart from each other in opposite sides. The first frame 11 and the second frame 12 are arranged in parallel to each other. The slats 50 and other components (not shown) of the treadmill 1 may be provided between the first frame 11 and the second frame 12. Although the first and second frames 11 and 12 are illustrated as separate elements in FIG. 1, the present disclosure is not limited thereto. The first and second frames 11 and 12 may be partial members arranged to be spaced apart from each other in a single frame.

The bearings 20 are provided in each of the first and second frames 11 and 12. For example, the bearings 20 may be ball bearings. The first and second belts 41 and 42 and the slats 50 fixedly connected to the first and second belts 41 and 42 may rotate due to the bearings 20. For example, the bearings 20 rotatably support the first and second belts 41 and 42, and therefore, the slats 50 fixedly connected to the first and second belts 41 and 42 may be rotatably supported by the bearings 20.

The front roller 31 is located in a front of each of the first and second frames 11 and 12. The rear roller 32 is located in a rear of each of the first and second frames 11 and 12. Together with the bearings 20, the front roller 31 and the rear roller 32 rotatably support the first and second belts 41 and 42 and the slats 50. A radius of each of the front and rear rollers 31 and 32 may be 15 mm to 300 mm.

The first belt 41 is rotatable and has an endless form. The first belt 41 is arranged to contact the front roller 31, the rear roller 32, and a plurality of bearings 20 provided in the first frame 11. Rotation of the first belt 41 is facilitated by the front roller 31, the rear roller 32, and the bearings 20.

The second belt 42 is rotatable and has an endless form. The second belt 42 is spaced apart from the first belt 41 and is arranged in parallel to the first belt 41. The second belt 42 is arranged to contact the front roller 31, the rear roller 32, and a plurality of bearings 20 provided in the second frame 12. Rotation of the second belt 42 is facilitated by the front roller 31, the rear roller 32, and the bearings 20.

The slats 50 may be arranged in a rotation direction of the first and second belts 41 and 42. Each of the slats 50 may extend perpendicularly to a direction in which the first and second frames 11 and 12 are located. For example, each of the slats 50 extends perpendicularly to the rotation direction of the first and second belts 41 and 42, and opposite ends of each of the slats 50 may be fixedly connected by the first and second belts 41 and 42.

As such, the slats 50 may be movably installed in the first and second frames 11 and 12 due to the bearings 20, the front and rear rollers 31 and 32, and the first and second belts 41 and 42.

Figure 4:
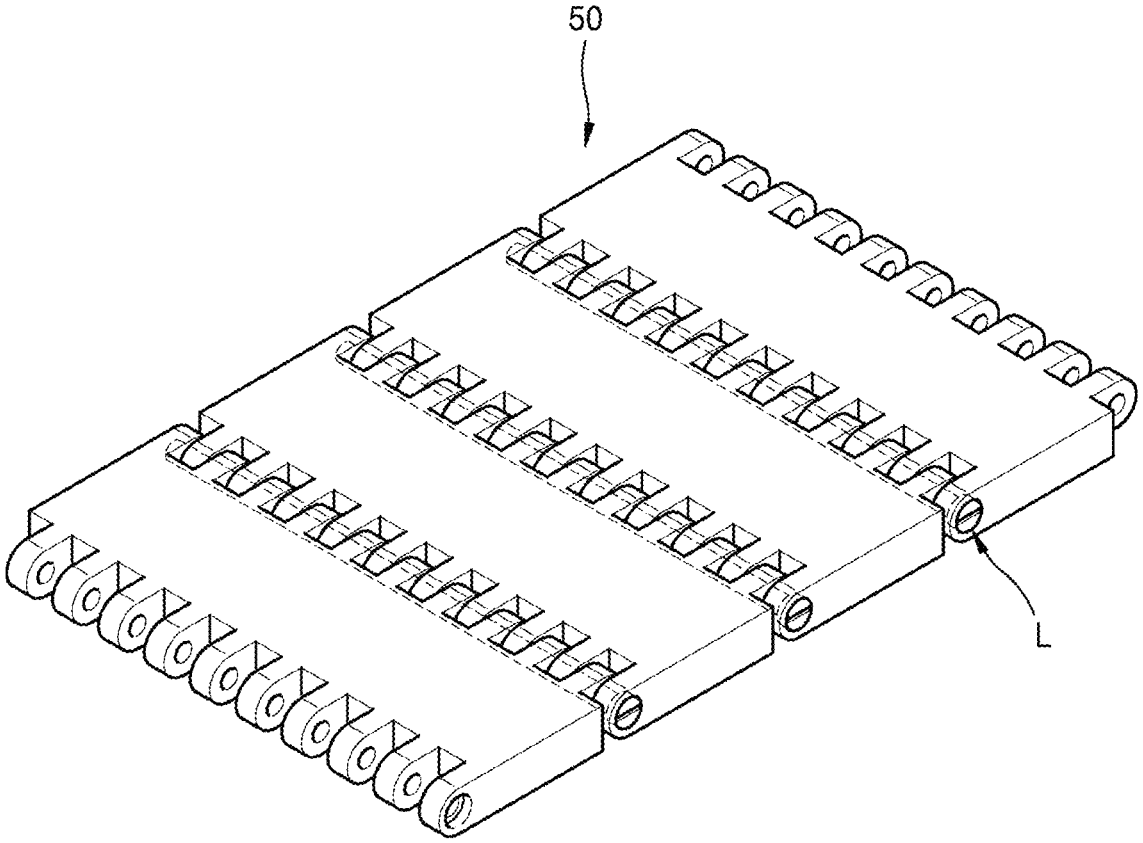
FIG. 4 is a perspective view conceptually illustrating another example of a connection structure of a plurality of slats.

Meanwhile, the first and second belts 41 and 42 respectively arranged in the opposite ends have been described as an example of a connection structure of the slats 50 in the embodiment described above, but the connection structure is not limited thereto and may be variously modified. For example, adjacent slats 50 may be connected by a link L, as shown in FIG. 4, without using the first and second belts 41 and 42.

The user U exercises on the slats 50 which are movable with respect to the first and second frames 11 and 12. The slats 50 bear a load of the user U and are rotated by the first and second belts 41 and 42 fixedly connected to opposite ends of each of the slats 50.

As such, when the slats 50 are moved and rotated while supporting the load of the user U, the slats 50 need to have sufficient strength to withstand not only the load of the user U but also a shock produced during exercise. In case of design without considering the strength of the slats 50, the slats 50 may be excessively bent or damaged by the load of the user U or a shock produced during exercise, causing anxiety or injury to the user U.

Meanwhile, increasing the entire thickness of the slats 50 may be considered to reinforce the strength of the slats 50. However, when the entire thickness of the slats 50 is increased, a thickness of an unnecessary portion is also increased, leading to an increase in a manufacturing cost.

In the treadmill 1 according to the current embodiment, the structure of at least some of the slats 50 will be improved to reinforce the strength of the slats 50 and save the material of the slats 50. Hereinbelow, an improved structure of the slats 50 will be described in detail.

Figure 5:
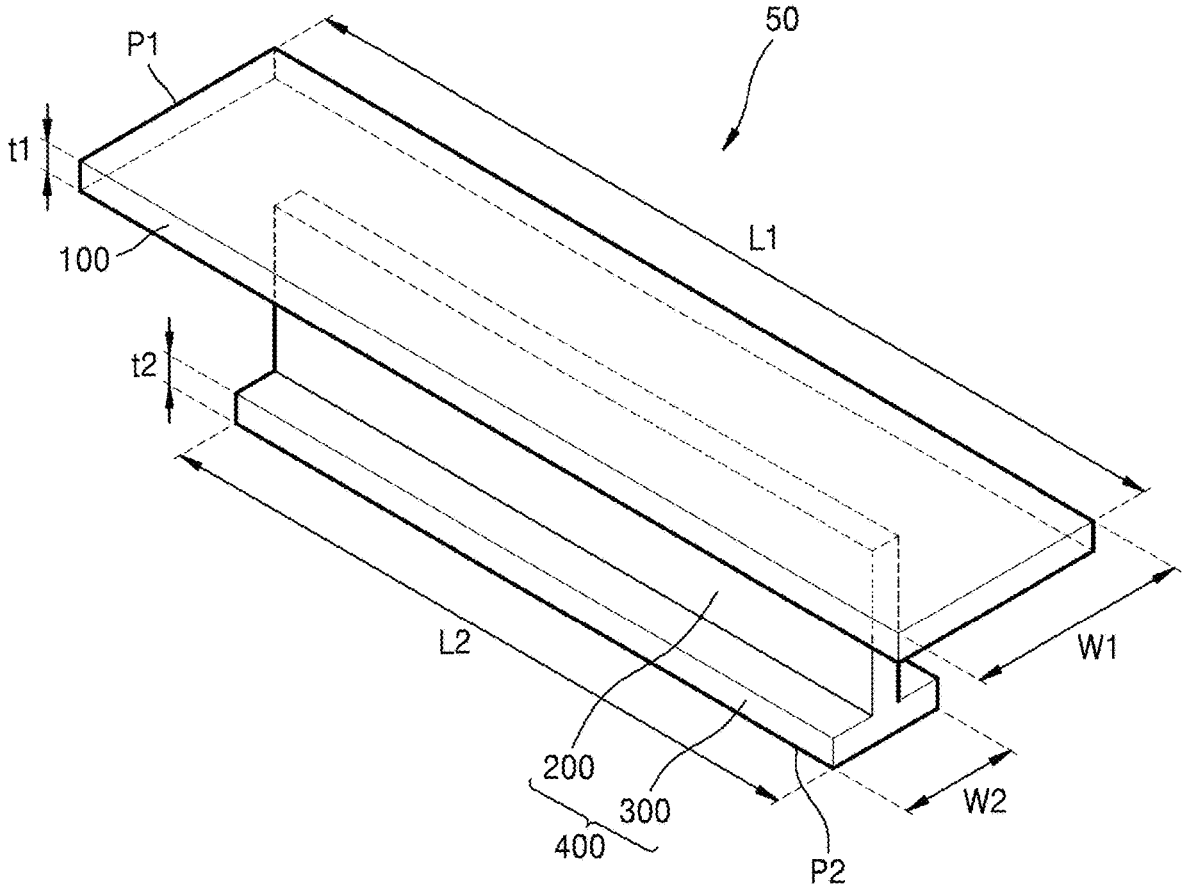
FIG. 5 is a perspective view of a slat according to an embodiment.

FIG. 5 is a perspective view of a slat 50 according to an embodiment.

Referring to FIGS. 3 and 5, the slat 50 includes a base portion 100, which provides a first surface P1 capable of supporting a user, and a strength reinforcing portion 400, which protrudes from the base portion 100 to reinforce a strength of the base portion 100.

The base portion 100 and the strength reinforcing portion 400 may be integrally formed in the slat 50. The slat 50 may include a moldable material, e.g., a material that allows injection molding, extrusion molding, or compression molding. For example, the slat 50 may include plastic or aluminum.

The base portion 100 may have a flat shape to provide the first surface P1 capable of supporting a user. The first surface P1 may be a plane. A thickness t1 of the base portion 100 may be 5 mm to 25 mm. A width W1 of the base portion 100 may be 3 mm to 150 mm. Here, a thickness refers to a thickness in the direction of gravity, and a width refers to a width in a moving direction of the slat 50.

A cross-sectional shape of the slat 50 may be roughly an I-shape. A cross-sectional shape of the strength reinforcing portion 400 may be a T-shape. The strength reinforcing portion 400 includes a first reinforcing portion 200, which protrudes from the base portion 100, and at least one second reinforcing portion 300, which extends in a direction intersecting the protruding direction of the first reinforcing portion 200 and provides a second surface P2. The second surface P2 may be a plane.

A protrusion height (h1 in FIG. 7A) of the first reinforcing portion 200 is less than a radius (R in FIG. 7A) of the rear roller 32. The protrusion height h1 of the first reinforcing portion 200 may be 1 mm to 150 mm. A width of the first reinforcing portion 200 may be equal to or less than half of the width W1 of the base portion 100.

A width W2 of the second reinforcing portion 300 is greater than the width of the first reinforcing portion 200. For example, the width W2 of the second reinforcing portion 300 may be at least twice the width of the first reinforcing portion 200. For example, the width W2 of the second reinforcing portion 300 may be at least five times the width of the first reinforcing portion 200. However, the width W2 of the second reinforcing portion 300 is less than the width W1 of the base portion 100. The width W2 of the second reinforcing portion 300 may be 2 mm to 100 mm.

The width W2 of the second reinforcing portion 300 may be two times to five times a thickness t2 of the second reinforcing portion 300. The thickness t2 of the second reinforcing portion 300 may be 1 mm to 25 mm. A length of the second reinforcing portion 300 may be the same as a length of the first reinforcing portion 200.

For example, the first reinforcing portion 200 may protrude perpendicularly to a direction of the first surface P1 of the base portion 100. The second reinforcing portion 300 may be located in parallel with the first surface P1 of the base portion 100. The first surface P1 and the second surface P2 may be parallel with each other. The first reinforcing portion 200 is located between the second reinforcing portion 300 and the base portion 100.

As such, the slat 50 is designed to have the second surface P2 spaced apart from the first surface P1 of the base portion 100 due to the strength reinforcing portion 400, increasing a section modulus and designing a neutral line away from the first surface P1. A weigh of each of the plurality of slats 50 may be 0.1 kg to 4 kg. A strength of each of the slats 50 may be 100 kgf/cm$^2$ to 700 kgf/cm$^2$.

Thus, the strength of each slat 50 with respect to the load of the user U and the shock may be reinforced, and the material of the slat 50 may be saved.

A length L2 of the strength reinforcing portion 400 is less than a length L1 of the base portion 100. The length L1 of the base portion 100 may be 30 cm to 110 cm, and the length L2 of the strength reinforcing portion 400 may be 10 cm to 100 cm. The length L2 of the strength reinforcing portion 400 is less than a distance between a bearing 20 installed in the first frame 11 and a bearing 20 installed in the second frame 12. The length L2 of the strength reinforcing portion 400 is less than a distance between the front roller 31 installed in the first frame 11 and the front roller 31 installed in the second frame 12. In addition, the length L2 of the strength reinforcing portion 400 is less than a distance between the rear roller 32 installed in the first frame 11 and the rear roller 32 installed in the second frame 12. Accordingly, the strength reinforcing portion 400 is prevented from bumping into a plurality of bearings 20, the front roller 31, and the rear roller 32 while the slat 50 is being moved and rotated by the bearings 20, the front roller 31, and the rear roller 32. Here, a length refers to a length in a direction perpendicular to the moving direction of the slat 50.

Figure 6:
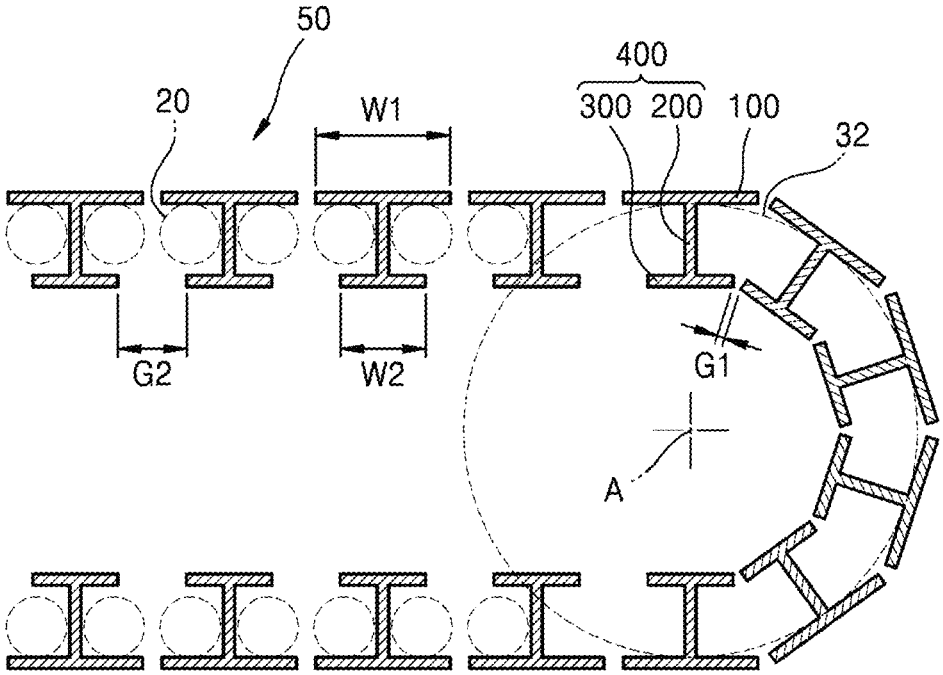
FIG. 6 conceptually illustrates a state where a plurality of slats move and rotate in a treadmill of the present disclosure.
Figure 7A:
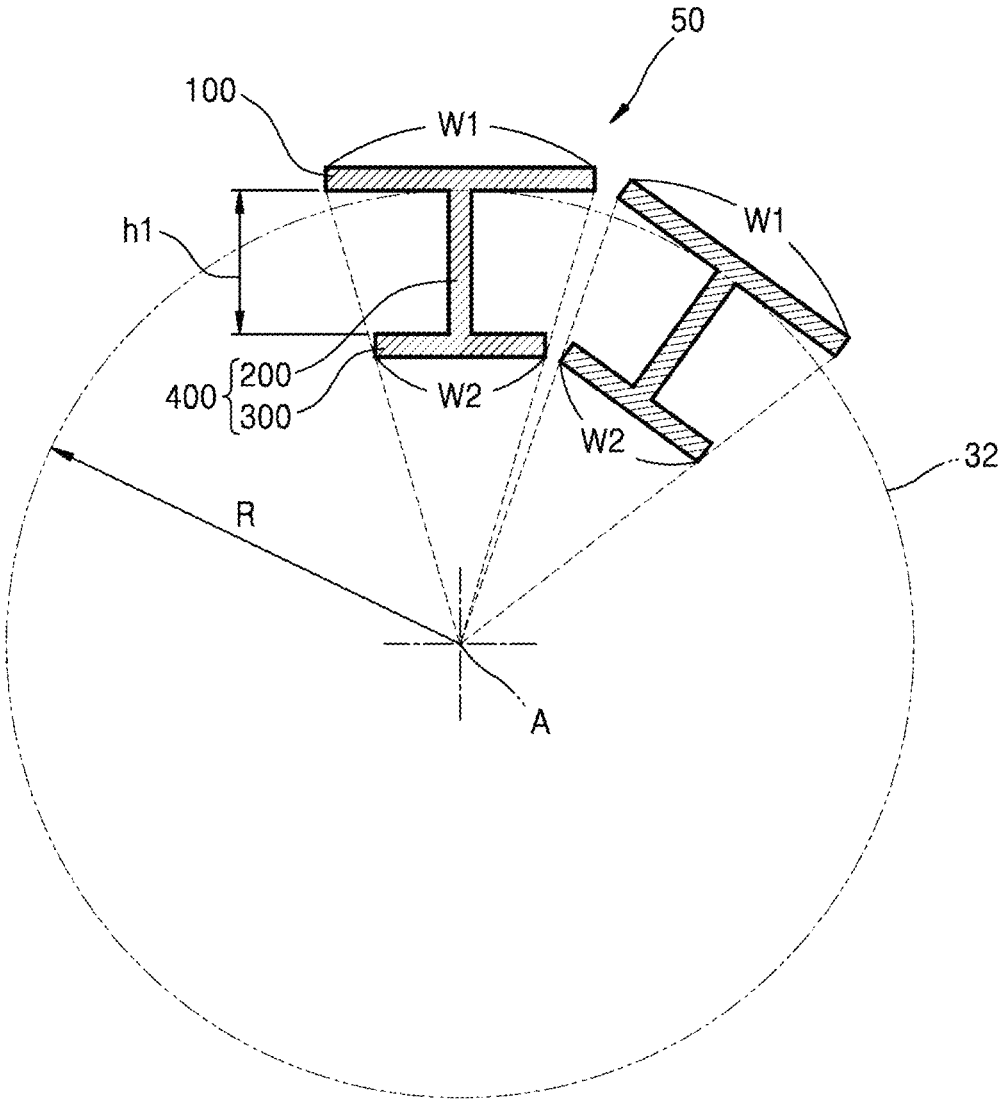
FIG. 7A conceptually illustrates a state where a plurality of slats rotate in the vicinity of a rear roller, and FIG. 7B enlargedly illustrates a portion of FIG. 7A.

FIG. 6 conceptually illustrates a state where a plurality of slats 50 move and rotate in the treadmill 1 of the present disclosure. FIG. 7A conceptually illustrates a state where a plurality of slats 50 rotate in the vicinity of the rear roller 32, and FIG. 7B enlargedly illustrates a portion of FIG. 7A. Although the state where the slats 50 are rotated by the rear roller 32 is illustrated in FIG. 6, the present disclosure is not limited thereto. It is apparent that the state may be applied to the front roller 31.

Referring to FIG. 6, the plurality of slats 50 are moved by the bearings 20 and rotated by the rear roller 32. A distance G1 between adjacent second reinforcing portions 300 while the slats 50 are being rotated by the rear roller 32 is less than a distance G2 between the adjacent second reinforcing portions 300 while the slats 50 are being moved by the bearings 20.

According to an embodiment, the treadmill 1 may have a structure in which adjacent second reinforcing portions 300 do not bump into each other even though the distance G1 between the adjacent second reinforcing portions 300 decreases as the slats 50 are rotated by the rear roller 32. Accordingly, noise occurring when the second reinforcing portions 300 of the respective slats 50 bump into each other may be prevented.

For this, the width W2 of the second reinforcing portion 300 may be less than the width W1 of the base portion 100 in at least some of the slats 50.

For example, the width W2 of the second reinforcing portion 300 may be 0.2 times to 0.8 times the width W1 of the base portion 100.

In another example, taking account of a maximum width $W2_{max}$ (hereinafter, referred to as a "maximum width $W2_{max}$ of the second reinforcing portion 300) not allowing adjacent second reinforcing portions 300 to bump into each other while the slats 50 is rotating around the rear roller 32, a width of the second reinforcing portion 300 may be designed to be equal to or less than the maximum width $W2_{max}$ of the second reinforcing portion 300. The maximum width $W2_{max}$ of the second reinforcing portion 300 may be determined by the width W1 of the base portion 100, the protrusion height h1 of the first reinforcing portion 200, and the radius R of the rear roller 32.

Figure 7B:
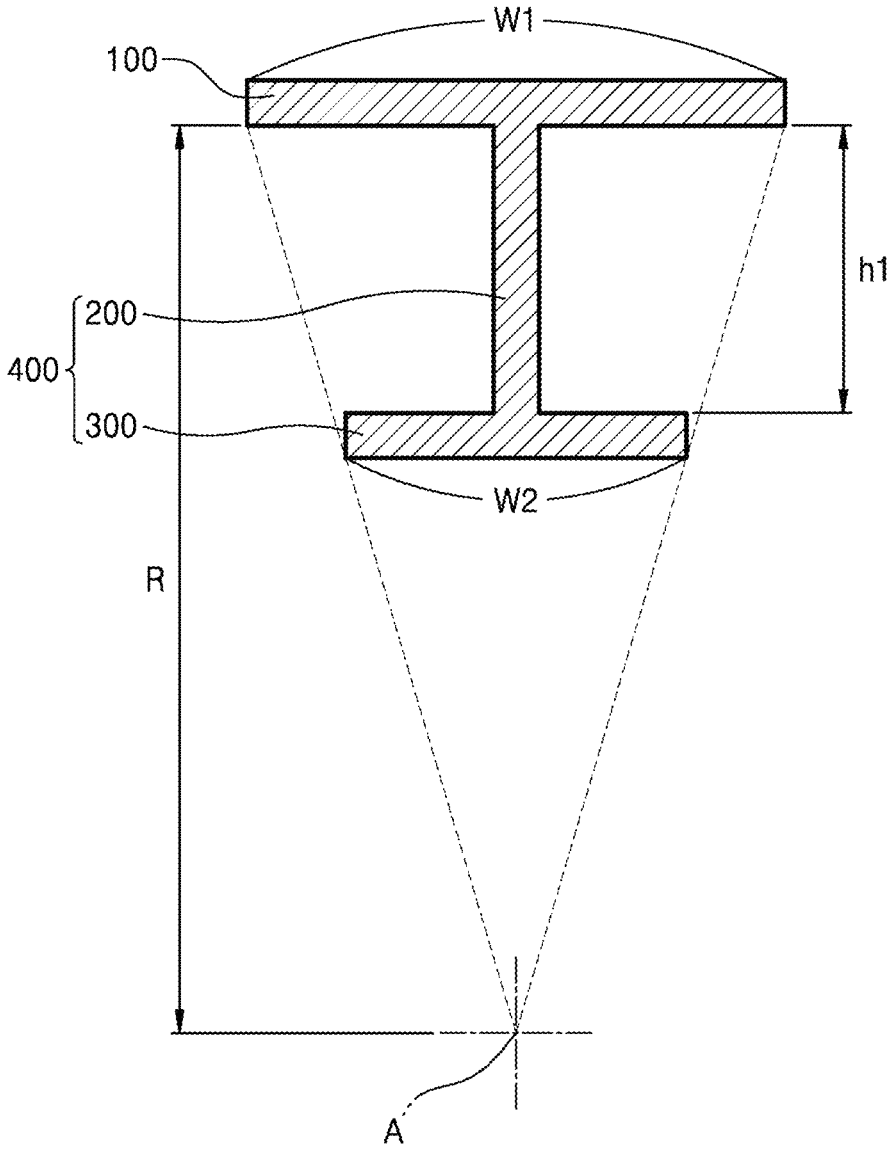

Referring to FIGS. 7A and 7B, a virtual triangle that connects opposite ends of the base portion 100 with a rotation center A of the rear roller 32 may be defined. When the second reinforcing portion 300 is located in the virtual triangle while each slat 50 is being rotated by the rear roller 32, the second reinforcing portion 300 does not bump into a second reinforcing portion 300 of an adjacent slat 50.

The maximum width $W2_{max}$ that does not allow a collision with the second reinforcing portion 300 may be determined by the width W1 of the base portion 100, the protrusion height h1 of the first reinforcing portion 200, and the radius R of the rear roller 32. For example, when an influence of the thickness t2 of the second reinforcing portion 300 is ignored, the maximum width $W2_{max}$ of the second reinforcing portion 300 may satisfy Relational Expression 1 below. Accordingly, the width W2 of the second reinforcing portion 300 may satisfy Relational Expression 2 below.

$$W2_{max}=(R-h1)/RW1. \quad (1)$$

$$W2\leq(R-h1)/RW1. \quad (2)$$

Figure 8A:
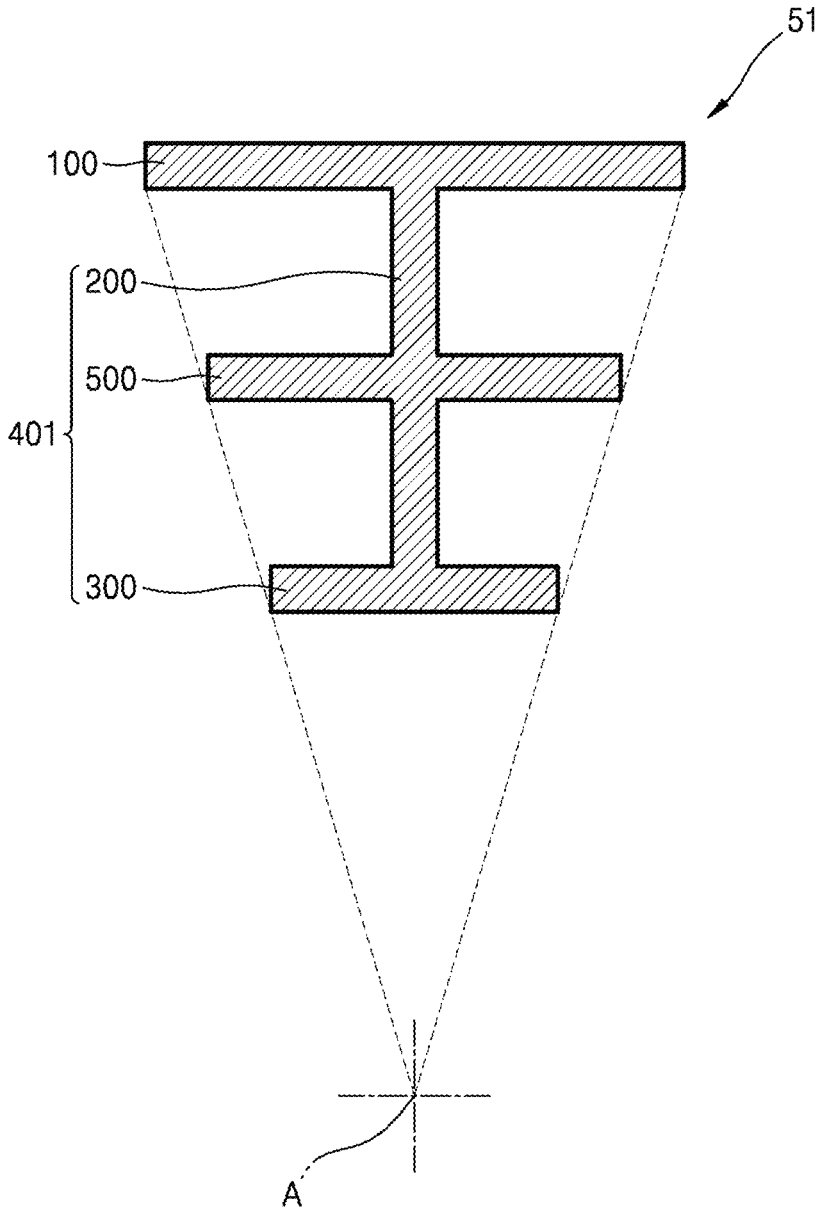
FIGS. 8A and 8B are cross-sectional views of slats, respectively, according to different embodiments.

In the embodiments described above, the strength reinforcing portion 400 has been described focusing on an example in which the second reinforcing portion 300 extends from the first reinforcing portion 200. However, the number of second reinforcing portions 300 in the strength reinforcing portion 400 of the slat is not limited to one. For example, as shown in FIG. 8A, a strength reinforcing portion 401 of a slat 51 may include a plurality of second reinforcing portions 300 and 500 extending from the first reinforcing portion 200, without departing a range of the virtual triangle.

Figure 8B:
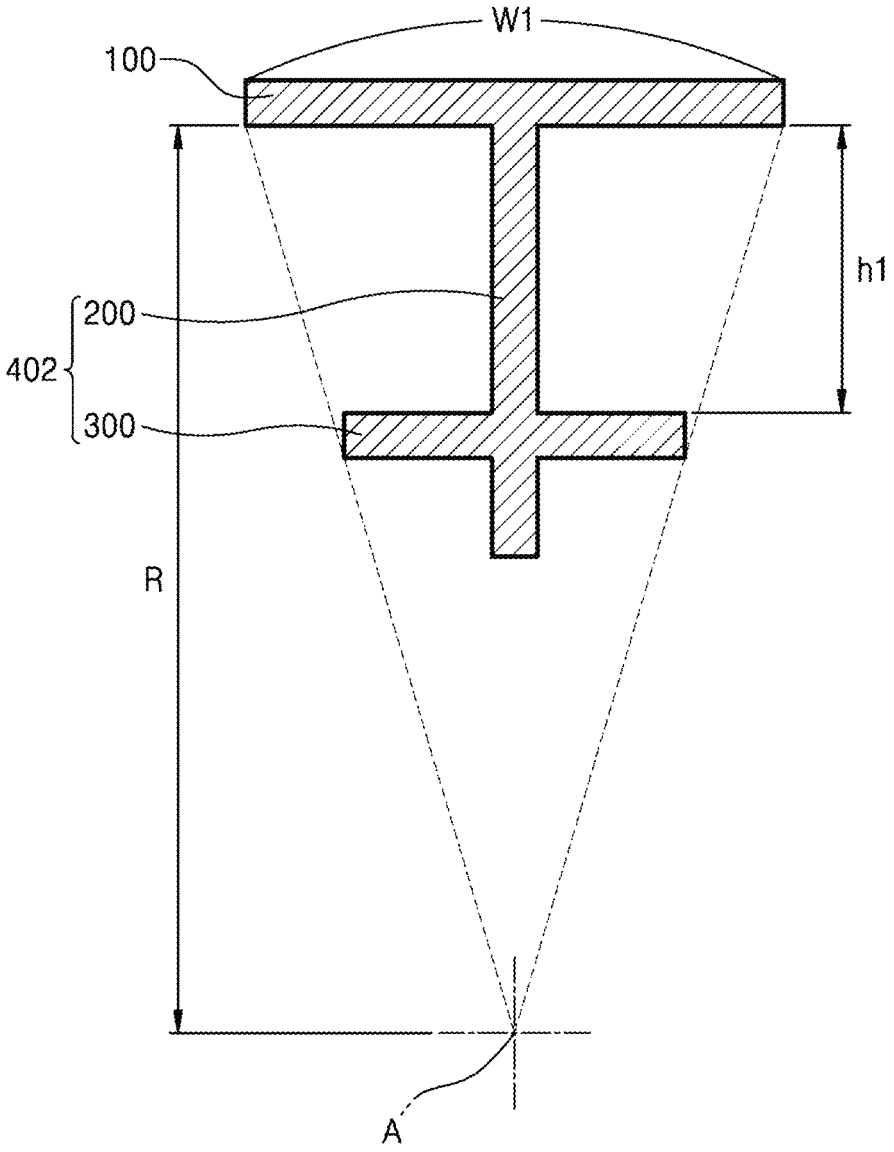

In addition, in the embodiments described above, the strength reinforcing portion 400 has been described focusing on an example in which the second reinforcing portion 300 extends at an end of the first reinforcing portion 200. However, the location of the second reinforcing portion 300 in the strength reinforcing portion 400 of the slat 50 is not limited thereto. For example, as shown in FIG. 8B, a strength reinforcing portion 402 of the slat 51 may include the second reinforcing portion 300 extending from a portion other than the end of the first reinforcing portion 200, without departing the range of the virtual triangle.

FIGS. 9A through 12C are perspective views of slats 50A, 50B, 50C, 50D, 50E, 50F, and 50G according to different embodiments. In FIGS. 9A through 12C, like reference numerals denote like elements, and redundant descriptions will be omitted. Hereinafter, descriptions will be focused on differences from the above-described embodiments.

Figure 9A:
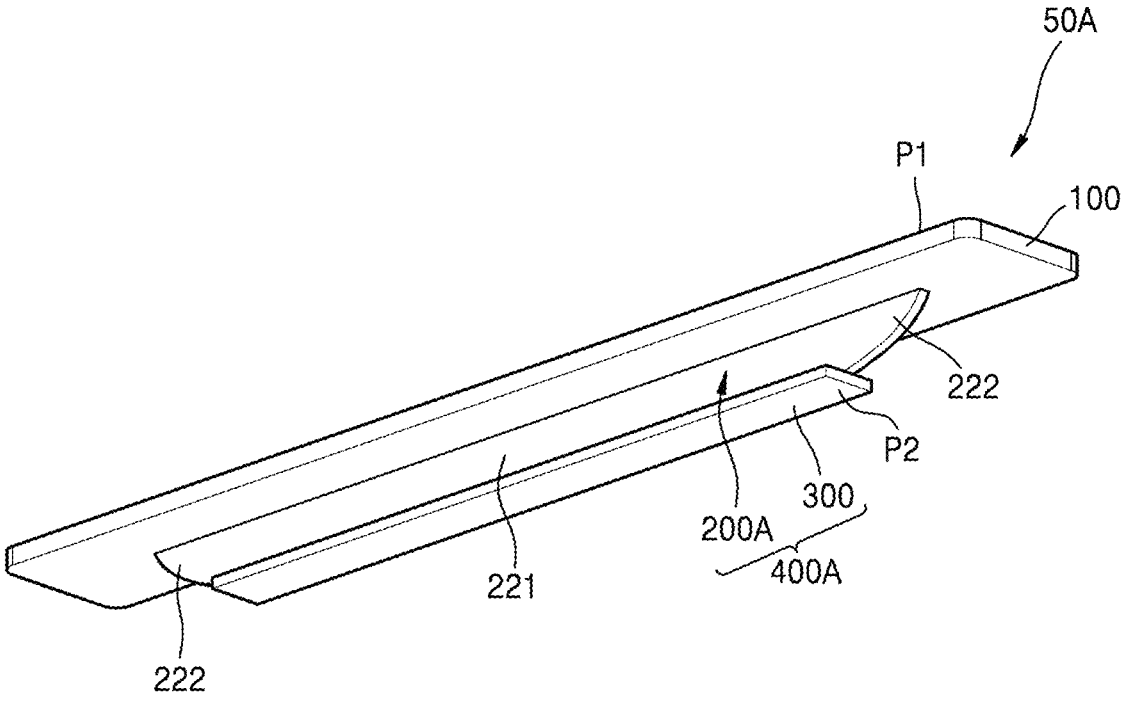
FIGS. 9A through 12C are perspective views of slats according to different embodiments.

Referring to FIG. 9A, a strength reinforcing portion 400A of the slat 50A includes a first reinforcing portion 200A and the second reinforcing portion 300.

The first reinforcing portion 200A includes a first region 221 having a certain height and a second region 222 having a height decreasing toward an end in a length direction. The first region 221 may be located between the base portion 100 and the second reinforcing portion 300.

A length of the first reinforcing portion 200A is greater than a length of the second reinforcing portion 300.

Figure 9B:
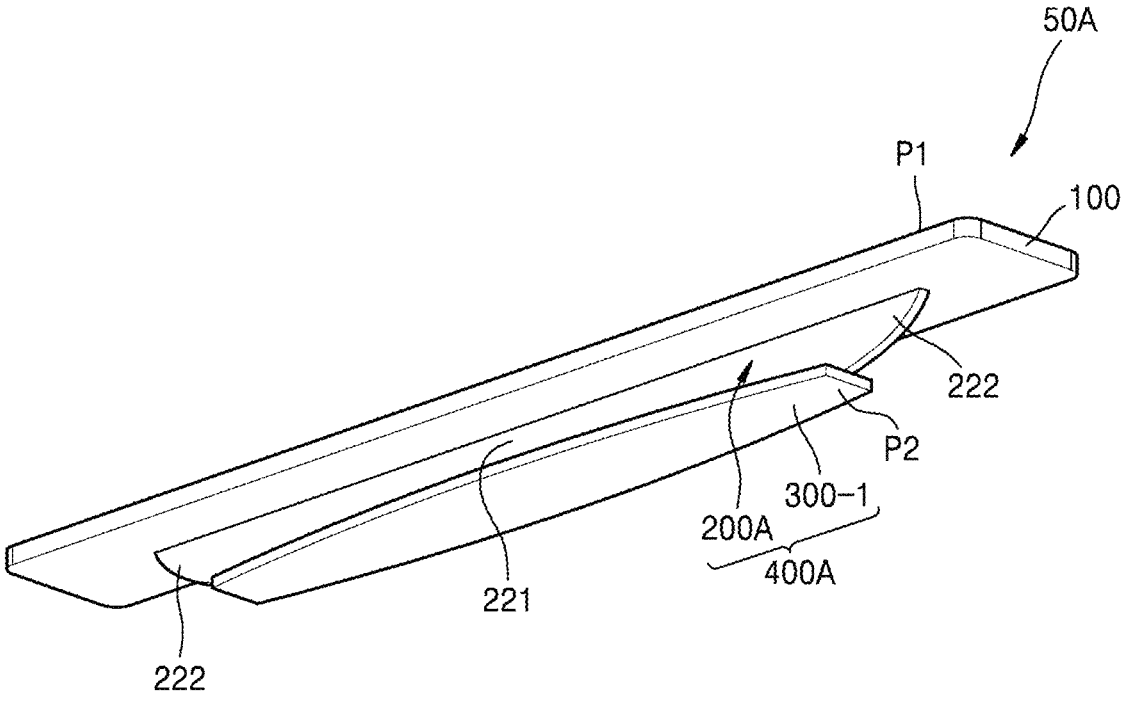

A width of the second reinforcing portion 300 may be uniform in the length direction but is not limited thereto. For example, as shown in FIG. 9B, a width of a second reinforcing portion 300-1 may decrease from a central portion toward opposite ends in the length direction.

Figure 10A:
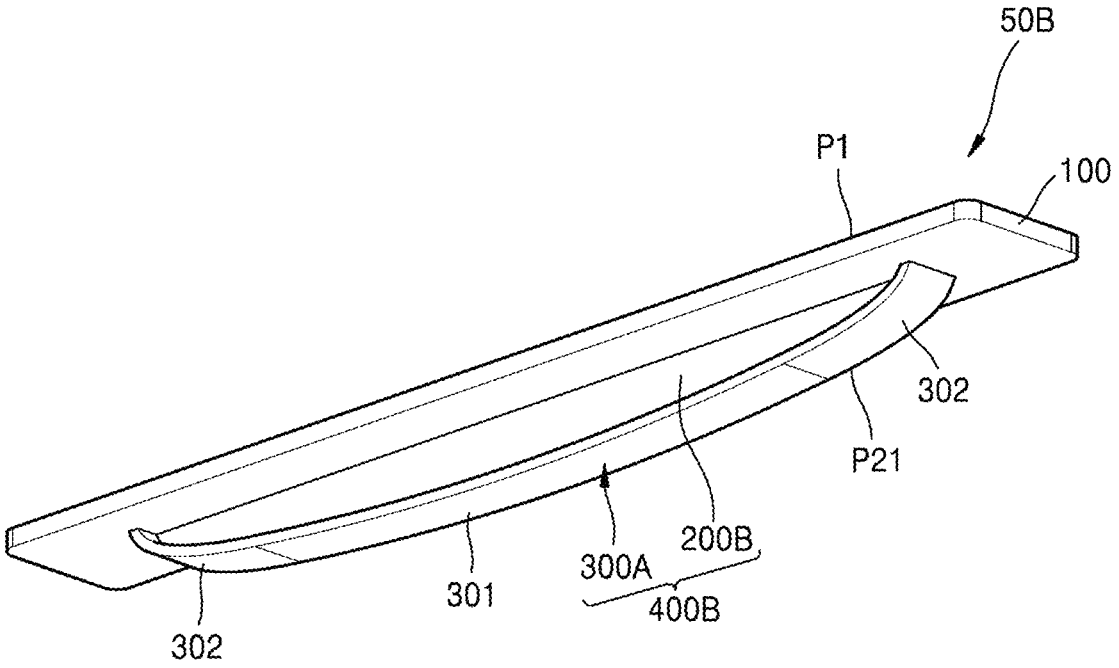

Referring to FIG. 10A, a strength reinforcing portion 400B of the slat 50B includes a first reinforcing portion 200B and a second reinforcing portion 300A.

The first reinforcing portion 200B may have a protrusion height that decreases from a center toward opposite ends in the length direction.

The second reinforcing portion 300A includes a separation region 301, which is located to be separated from the base portion 100, and a contact region 302, which is located at each of opposite ends of the separation region 301 and is in contact with the base portion 100. A second surface P21 of the second reinforcing portion 300A may be a curved surface, and the first surface P1 of the base portion 100 may be a plane surface.

Figure 10B:
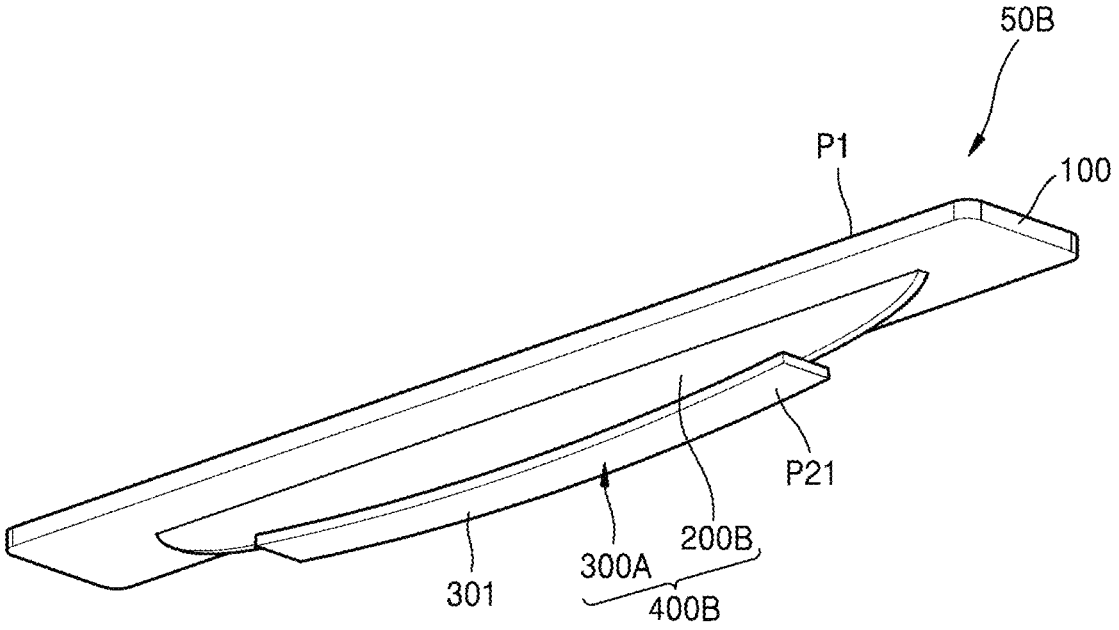
Figure 10C:
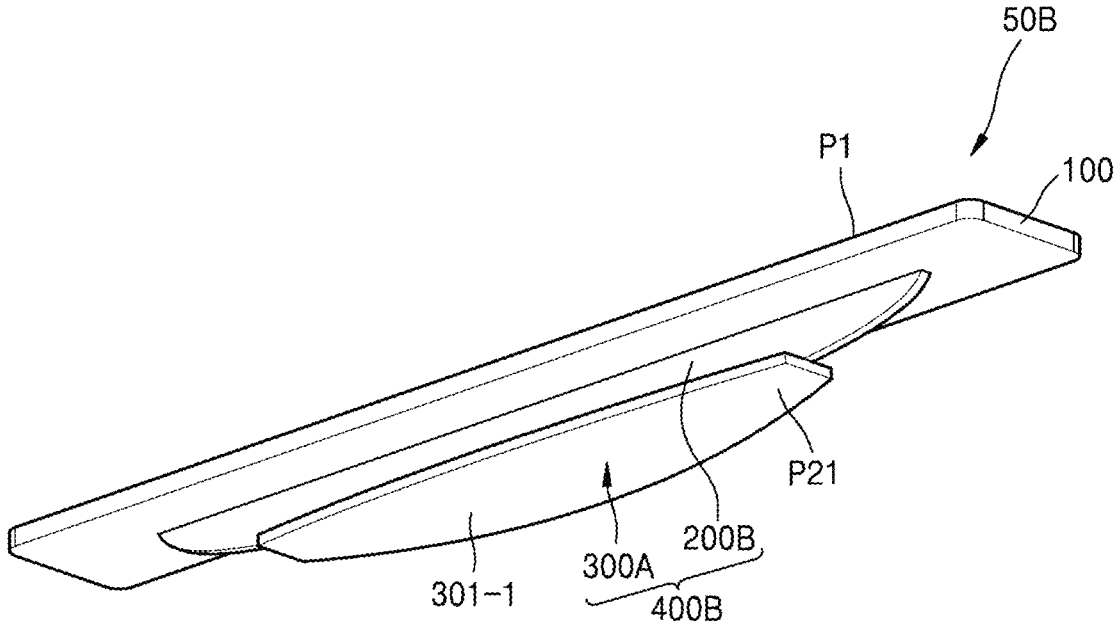

In another example, referring to FIGS. 10B and 10C, the second reinforcing portion 300A may include the separation region 301 or a separation region 301-1, which is located to be separated from the base portion 100, but may not include the contact region 302. The second surface P21 of the second reinforcing portion 300A may be a curved surface, and the first surface P1 of the base portion 100 may be a plane surface.

For example, referring to FIG. 10B, a width of the separation region 301 may be uniform in the length direction but is not limited thereto. For example, as shown in FIG. 10C, a width of the separation region 301-1 may decrease from a central portion toward opposite ends in the length direction.

Figure 11A:
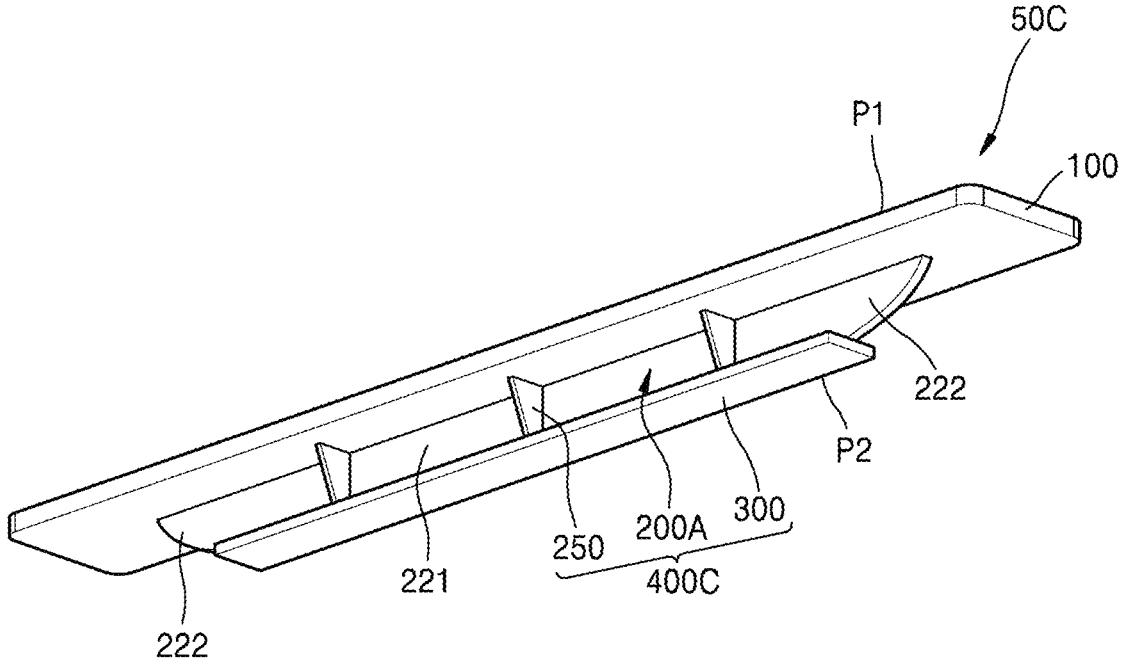
Figure 11B:
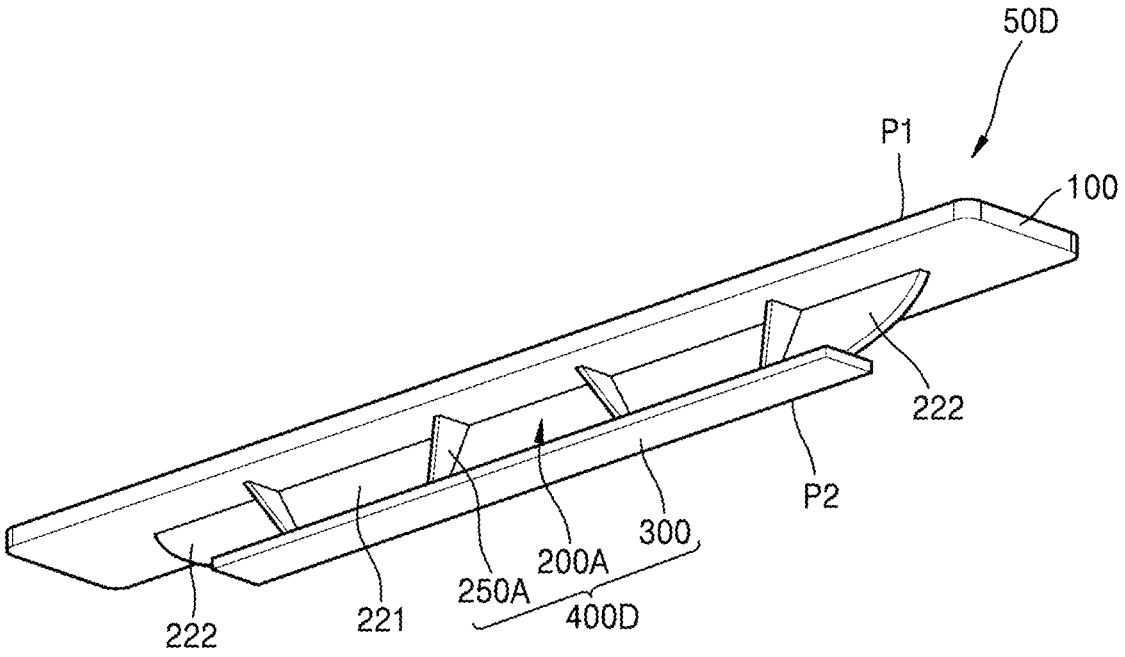

Referring to FIGS. 11A and 11B, each of strength reinforcing portions 400C and 400D of the respective slats 50C and 50D includes the first reinforcing portion 200A, the second reinforcing portion 300, and at least one rib 250 or 250A.

The rib 250 or 250A protrudes from the base portion 100 and is located between the second reinforcing portion 300 and the base portion 100. The rib 250 or 250A may support the first reinforcing portion 200A. The at least one rib 250 or 250A may be a plurality of ribs 250 or 250A spaced apart from each other in a length direction of the slat 50C or 50D.

For example, a rib 250 may protrude perpendicularly to the first surface P1 of the base portion 100, as shown in FIG. 11A.

In another example, a rib 250A may protrude to be at an acute or obtuse angle to the first surface P1 of the base portion 100, as shown in FIG. 11B.

In an embodiment, each of the strength reinforcing portions 400C and 400D may additionally supplement the strength by further including the rib 250 or 250A.

Figure 12A:
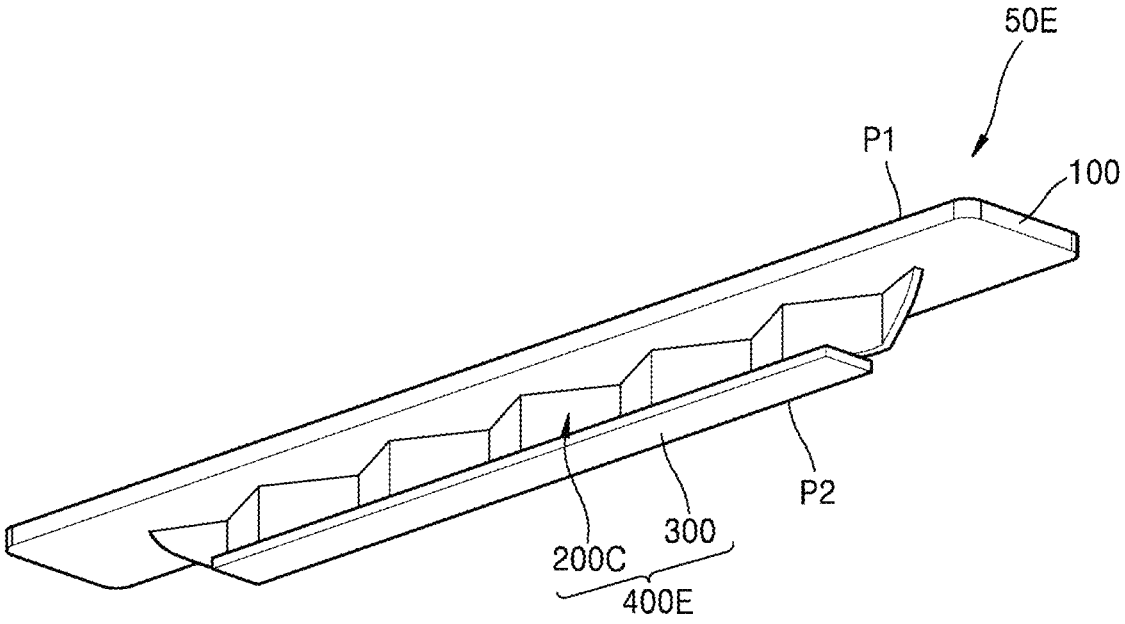
Figure 12B:
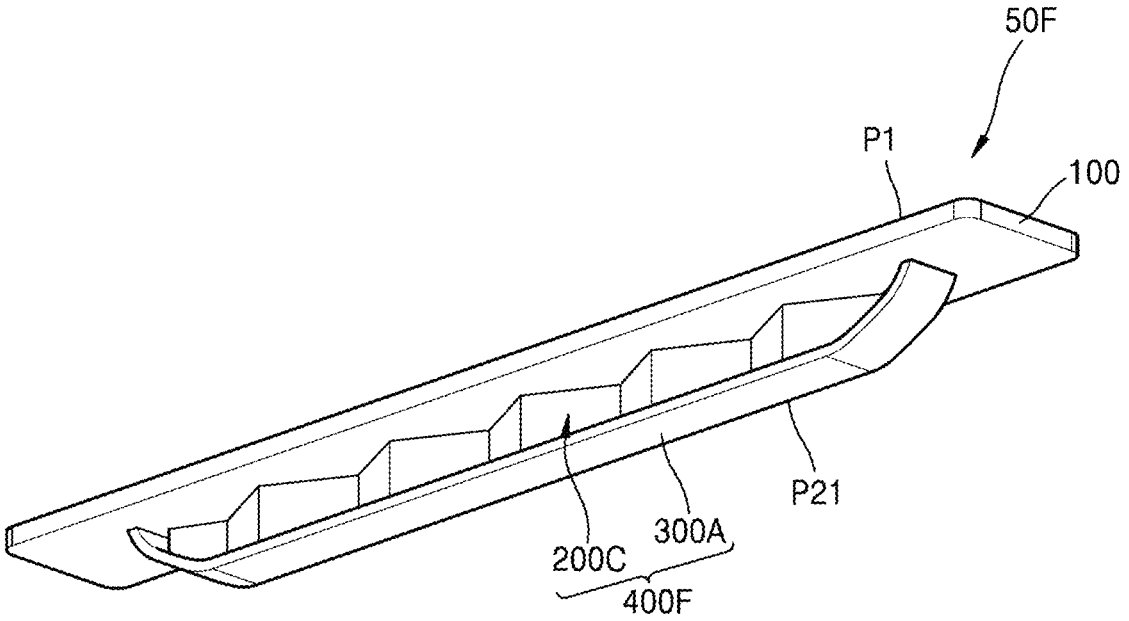
Figure 12C:
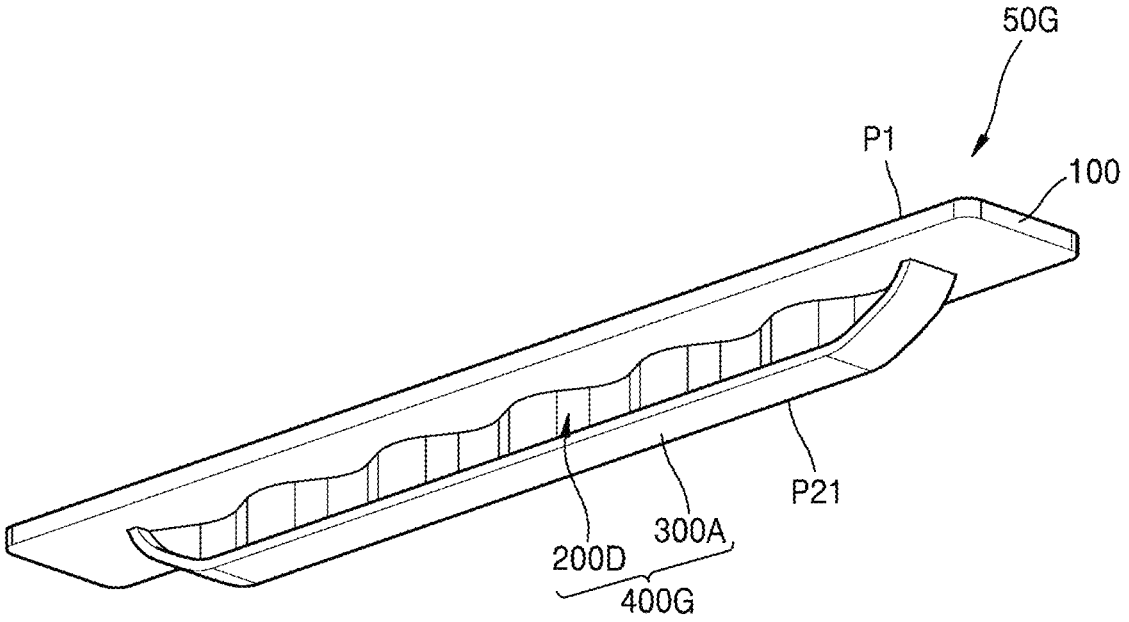

Referring to FIGS. 12A through 12C, in an embodiment, each of the strength reinforcing portions 400E, 400F, and 400G of the respective slats 50E, 50F, and 50G includes a first reinforcing portion 200C or 200D and the second reinforcing portion 300 or 300A.

The first reinforcing portion 200C or 200D may extend in directions not parallel with a length direction of the slats 50E, 50F, and 50G.

For example, the first reinforcing portion 200C may extend in a zigzag shape, as shown in FIGS. 12A and 12B. A cross-section of the first reinforcing portion 200C, taken parallel to the first surface P1, may have the zigzag shape.

In another example, the first reinforcing portion 200D may extend in shape of waves, as shown in FIG. 12C. A cross-section of the first reinforcing portion 200D, taken parallel to the first surface P1, may have the shape of waves.

However, the shapes of the first reinforcing portions 200C and 200D are not limited thereto. The first reinforcing portions 200C and 200D may have various shapes and extend in directions not parallel with the length direction of the slats 50E, 50F, and 50G.

Figure 13:
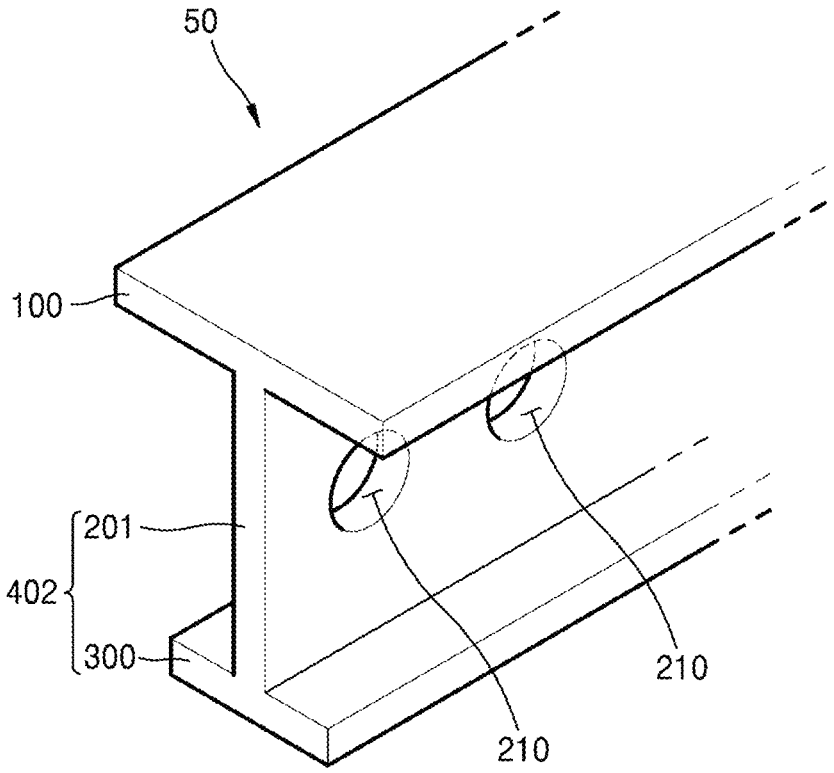
FIG. 13 is a partial perspective view of a slat according to another embodiment.

FIG. 13 is a partial perspective view of the slat 50 according to another embodiment.

Referring to FIG. 13, the slat 50 includes the base portion 100 and a strength reinforcing portion 402. The strength reinforcing portion 402 includes a first reinforcing portion 201 and the second reinforcing portion 300. The same elements as described in the embodiments described above are denoted by like reference numerals, and redundant descriptions will be omitted.

The first reinforcing portion 201 may protrude perpendicularly to the direction of the first surface P1 of the base portion 100. At least one insertion portion 210 may be formed in the first reinforcing portion 201. The insertion portion 210 may have a hole shape penetrating the first reinforcing portion 201. The material of the slat 50 may be saved by forming the insertion portion 210 in the first reinforcing portion 201.

The insertion portion 210 may have a circular shape. However, the shape of the insertion portion 210 is not limited to the circular shape but may be various. For example, the shape of the insertion portion 210 may be a polygon, e.g., a triangle or a quadrangle.

A plurality of insertion portions 210 may be provided. A distance between the insertion portions 210 may be uniform but is not limited thereto and may vary. In addition, the sizes and shapes of the insertion portions 210 may be the same among the insertion portions 210 but are not limited thereto. At least one of the size and the shape may be different among the insertion portions 210.

Meanwhile, the embodiments have been described, focusing on an example in which a plurality of bearings 20 provided in each of the first and second frames 11 and 12 are arranged in a straight line. However, it is apparent that the arrangement of the bearings 20 in the treadmill 1 may be changed. For example, the arrangement of the bearings 20 may have a concave at the center.

In addition, the treadmill 1 may not include a separate driving source for rotating the first and second belts 41 and 42. In other words, the treadmill 1 may be a non-electric powered treadmill 1 which is rotated by the legs of the user U. However, the treadmill 1 is not limited to the non-electric powered treadmill 1 and may include a separate driving source.

Other aspects, features, and advantages than those described above will be clear from the accompanying drawings, the claims, and the description of embodiments below. These general and specific aspects may be embodied using a system, a method, a computer program, or a combination thereof.

What is claimed is:

1. A treadmill comprising:

a first frame and a second frame arranged in parallel with each other, each of the first and second frames extending in a first direction;

a front roller and a rear roller respectively provided in the first frame and the second frame; and a plurality of slats arranged between the first frame and the second frame and installed movably with respect to the first frame and the second frame, each of the plurality of slats extending in a second direction crossing the first frame and the second frame, wherein at least one of the plurality of slats comprises a base portion providing a slat top surface and a strength reinforcing portion attached to the base portion, and wherein the strength reinforcing portion comprises:

a first reinforcing portion protruding from the base portion; and at least one second reinforcing portion vertically overlapping the first reinforcing portion and extending in the second direction, the at least one second reinforcing portion comprising a first major surface facing the base portion and a second major surface that is opposite to the first major surface and provides a slat bottom surface, and wherein the second reinforcing portion comprises:

a separation region extending in the second direction and separated from the base portion by the first reinforcing portion such that the first reinforcing portion is interposed between the separation region and the base portion, wherein the separation region has a width greater than that of the first reinforcing portion; and a contact region located at each of opposite ends of the separation region, the contact region being in direct physical contact with the base portion, wherein the contact region has a width greater than that of the first reinforcing portion.

2. The treadmill of claim 1, wherein the slat top surface is plane and the slat bottom surface is curved.

3. The treadmill of claim 1, wherein a cross-section of the first reinforcing portion, taken parallel to the slat top surface, has a zigzag shape or a shape of waves.

4. The treadmill of claim 1, wherein the plurality of slats comprise plastic or aluminum.

5. The treadmill of claim 1, wherein the first reinforcing portion has a top surface contacting the base portion and a bottom surface contacting the first major surface of the second reinforcing portion, and wherein the first major surface of the second reinforcing portion fully surrounds the bottom surface of the first reinforcing portion in a direction of the length of the first reinforcing portion.

6. The treadmill of claim 1, wherein the first reinforcing portion has a top surface contacting the base portion and a bottom surface contacting the first major surface of the second reinforcing portion and being downwardly curved, wherein the second reinforcing portion is downwardly curved to correspond to a curvature of the bottom surface of the first reinforcing portion.

7. The treadmill of claim 1, wherein the contact region is curved.

8. The treadmill of claim 1, wherein the second reinforcing portion is longer than the first reinforcing portion.

9. The treadmill of claim 1, wherein the second reinforcing portion vertically overlaps the first reinforcing portion.

* * * * *